US007849586B2

(12) United States Patent
Sutardja

(10) Patent No.: US 7,849,586 B2
(45) Date of Patent: Dec. 14, 2010

(54) METHOD OF MAKING A POWER INDUCTOR WITH REDUCED DC CURRENT SATURATION

(75) Inventor: Sehat Sutardja, Los Altos Hills, CA (US)

(73) Assignee: Marvell World Trade Ltd., St. Michael (BB)

( * ) Notice: Subject to any disclaimer, the term of this patent is extended or adjusted under 35 U.S.C. 154(b) by 159 days.

(21) Appl. No.: 11/327,065

(22) Filed: Jan. 6, 2006

(65) Prior Publication Data

US 2006/0114093 A1 Jun. 1, 2006

Related U.S. Application Data

(60) Division of application No. 10/744,416, filed on Dec. 22, 2003, now Pat. No. 7,489,219, and a continuation-in-part of application No. 10/621,128, filed on Jul. 16, 2003, now Pat. No. 7,023,313.

(51) Int. Cl.
*H01F 3/00* (2006.01)
*H01F 41/02* (2006.01)

(52) U.S. Cl. ..... 29/604; 29/602.1; 29/605; 29/606; 216/62; 216/65; 216/66; 336/110; 336/178; 336/184; 336/214; 336/215; 363/17; 363/48; 363/58; 451/5; 451/41

(58) Field of Classification Search ..... 29/417, 29/602.1, 604, 606, 607; 336/110, 178, 184, 336/214, 215, 234; 363/17, 48, 58; 216/62, 216/65, 66; 451/5, 41
See application file for complete search history.

(56) References Cited

U.S. PATENT DOCUMENTS

| | | | | |
|---|---|---|---|---|
| 3,146,300 | A | 8/1964 | Beckius et al. | 174/127 |
| 3,305,697 | A | 2/1967 | Neusbaum | 315/244 |
| 3,579,214 | A | 5/1971 | Solyst | |
| 3,599,325 | A | 8/1971 | Burr et al. | |
| 3,851,375 | A | 12/1974 | Koomeef | |
| 4,020,439 | A | 4/1977 | Thiessens et al. | |
| 4,031,496 | A * | 6/1977 | Fujiwara et al. | 336/135 |
| 4,040,174 | A * | 8/1977 | Tsuda | 29/603.16 |
| 4,047,138 | A | 9/1977 | Steigerwald | |
| 4,203,081 | A | 5/1980 | Braeckelmann | 333/138 |
| 4,313,152 | A | 1/1982 | Vranken | |

(Continued)

FOREIGN PATENT DOCUMENTS

CN 1292636 A 4/2001

(Continued)

OTHER PUBLICATIONS

"Understanding Ferrite Bead Inductors", http://www.murata.com, pp. 23-25 (unknown date of publication).

(Continued)

*Primary Examiner*—Paul D Kim

(57) ABSTRACT

A method for making a power inductor comprises providing a first magnetic core comprising a ferrite bead core material, cutting a first cavity and a first air gap in said first magnetic core, and attaching a second magnetic core to said first magnetic core at least one of in and adjacent to said air gap.

8 Claims, 9 Drawing Sheets

U.S. PATENT DOCUMENTS

| | | | | |
|---|---|---|---|---|
| 4,475,143 | A | 10/1984 | Hernandez | |
| 4,527,032 | A | 7/1985 | Young et al. | |
| 4,536,733 | A | 8/1985 | Shelly et al. | |
| 4,578,664 | A | 3/1986 | Kinzler et al. | |
| 4,583,068 | A | 4/1986 | Dickens et al. | |
| 4,616,205 | A | 10/1986 | Praught et al. | 336/65 |
| 4,630,170 | A | 12/1986 | Kask et al. | |
| 4,638,279 | A | 1/1987 | Brisson et al. | |
| 4,675,629 | A | 6/1987 | Sakamoto et al. | |
| 4,728,810 | A | 3/1988 | Engel | |
| 4,801,912 | A | 1/1989 | McElheny et al. | |
| 4,803,609 | A | 2/1989 | Gillett et al. | 363/17 |
| 5,057,805 | A | 10/1991 | Kadowaki | |
| 5,175,525 | A | 12/1992 | Smith | |
| 5,186,647 | A | 2/1993 | Denkmann et al. | 439/395 |
| 5,204,809 | A | 4/1993 | Andresen | |
| 5,225,971 | A | 7/1993 | Spreen | |
| 5,303,115 | A | 4/1994 | Nayar et al. | |
| 5,362,257 | A | 11/1994 | Neal et al. | 439/676 |
| 5,363,035 | A | 11/1994 | Hutchison et al. | |
| 5,400,006 | A | 3/1995 | Cardozo | |
| 5,403,196 | A | 4/1995 | Northey et al. | |
| 5,403,208 | A | 4/1995 | Felcman et al. | |
| 5,410,180 | A | 4/1995 | Fujii et al. | |
| 5,444,600 | A | 8/1995 | Dobkin et al. | |
| 5,481,238 | A | 1/1996 | Carsten et al. | |
| 5,500,629 | A | 3/1996 | Meyer | |
| 5,509,691 | A * | 4/1996 | Kaule et al. | 283/67 |
| 5,526,565 | A | 6/1996 | Roberts | 29/884 |
| 5,554,050 | A | 9/1996 | Marpoe, Jr. | |
| 5,586,914 | A | 12/1996 | Foster et al. | 439/676 |
| 5,611,700 | A | 3/1997 | Mitra | |
| 5,650,357 | A | 7/1997 | Dobkin et al. | |
| 5,781,093 | A | 7/1998 | Grandmont et al. | 336/232 |
| 5,802,709 | A | 9/1998 | Hogge et al. | |
| 5,808,537 | A | 9/1998 | Kondo et al. | |
| 5,834,591 | A | 11/1998 | Aoki | |
| 5,889,373 | A | 3/1999 | Fisher et al. | |
| 5,909,037 | A | 6/1999 | Rajkomar et al. | |
| 5,926,358 | A | 7/1999 | Dobkin et al. | |
| 6,049,264 | A | 4/2000 | Salier et al. | |
| 6,054,764 | A | 4/2000 | Howser et al. | 257/724 |
| 6,137,389 | A | 10/2000 | Uchikoba | |
| 6,144,269 | A | 11/2000 | Okamoto et al. | 333/184 |
| 6,184,579 | B1 | 2/2001 | Sasov | |
| 6,191,673 | B1 | 2/2001 | Ogura et al. | |
| 6,225,727 | B1 * | 5/2001 | Oohashi et al. | 310/263 |
| 6,287,164 | B1 | 9/2001 | Radloff | |
| 6,310,534 | B1 | 10/2001 | Brunner | |
| 6,356,179 | B1 | 3/2002 | Yamada | |
| 6,362,986 | B1 | 3/2002 | Schultz et al. | |
| 6,438,000 | B1 | 8/2002 | Okamoto et al. | |
| 6,459,349 | B1 | 10/2002 | Giday et al. | |
| 6,483,623 | B1 | 11/2002 | Maruyama | 398/182 |
| 6,512,437 | B2 | 1/2003 | Jin et al. | |
| 6,556,456 | B1 * | 4/2003 | Takehara | 361/818 |
| 6,583,697 | B2 | 6/2003 | Koyama et al. | 336/83 |
| 6,612,890 | B1 | 9/2003 | Radloff | |
| 6,683,522 | B2 | 1/2004 | Walsh | |
| 6,686,823 | B2 | 2/2004 | Arntz et al. | |
| 6,820,321 | B2 | 11/2004 | Harding | |
| 6,879,237 | B1 | 4/2005 | Viarouge et al. | |
| 6,967,553 | B2 | 11/2005 | Jitaru | |
| 2001/0052837 | A1 | 12/2001 | Walsh | |
| 2002/0039061 | A1 | 4/2002 | Timashov | |
| 2002/0109782 | A1 | 8/2002 | Ejima et al. | |
| 2002/0140464 | A1 | 10/2002 | Yampolsky et al. | |
| 2002/0157117 | A1 | 10/2002 | Geil et al. | |
| 2003/0011371 | A1 | 1/2003 | Rosthal et al. | |
| 2003/0227366 | A1 | 12/2003 | Lin | |
| 2005/0016815 | A1 | 1/2005 | Martin et al. | 194/317 |
| 2006/0116623 | A1 | 6/2006 | Han et al. | |

FOREIGN PATENT DOCUMENTS

| | | | |
|---|---|---|---|
| DE | 3622190 | A | 1/1988 |
| EP | 0484074 | A | 5/1992 |
| EP | 0895257 | A | 2/1999 |
| FR | 2620852 | | 3/1989 |
| GB | 2318691 | A | 4/1998 |
| JP | 57089212 | | 6/1982 |
| JP | 57193007 | | 11/1982 |
| JP | 57191011 | | 12/1982 |
| JP | 58224420 | A | 12/1983 |
| JP | 59009526 | | 1/1984 |
| JP | 61078111 | A * | 4/1986 |
| JP | 63006712 | | 1/1988 |
| JP | 02125404 | A * | 5/1990 |
| JP | 02251107 | | 10/1990 |
| JP | 04-062807 | | 2/1992 |
| JP | 5267064 | | 10/1993 |
| JP | 06260869 | | 9/1994 |
| JP | 8-69934 | A | 3/1996 |
| JP | 8107021 | | 4/1996 |
| JP | 6061707 | | 8/1997 |
| JP | 10335146 | | 12/1998 |
| JP | 11008123 | | 1/1999 |
| JP | 11074125 | A | 3/1999 |
| JP | 11186045 | | 7/1999 |
| JP | 11204354 | A | 7/1999 |
| JP | 11233348 | | 8/1999 |
| JP | 11273975 | | 8/1999 |
| JP | 11354329 | | 12/1999 |
| JP | 2002057039 | A | 2/2002 |
| JP | 2002057049 | | 2/2002 |
| JP | 2002075737 | | 3/2002 |
| JP | 2003124015 | | 4/2003 |
| JP | 2003142319 | | 5/2003 |
| JP | 2003332141 | A | 11/2003 |
| JP | 2003347130 | | 12/2003 |
| JP | 2006095956 | | 4/2006 |
| TW | 403917 | | 9/2000 |
| TW | 445467 | | 7/2001 |
| WO | WO00/74089 | A1 | 12/2000 |
| WO | WO02/25677 | A2 | 3/2002 |
| WO | WO02/095775 | A | 11/2002 |
| WO | WO02/095775 | A1 | 11/2002 |

OTHER PUBLICATIONS

"Using Ferrite Beads to Keep RF Out Of TV Sets, Telephones, VCR's, Burglar Alarms and Other Electronic Equipment", http://www.antennex.com, pp. 1-4 (unknown date of publication).

European Search Report for Application No. 04020571.8, 3 pages.

European Search Report for Application No. 04020568.4, 3 pages.

European Search Report for Application No. 04010841, 2 pages.

European Search Report for Application No. 04011558.6, 2 pages.

Organized Translation of Non-Final Rejection from the Japanese Patent Office dated Apr. 14, 2009; 5 pages.

Official Communication from the European Patent Office dated Dec. 22, 2009 for Application No. 04 020 568.4-1231; 6 pages.

Official Communication from the European Patent Office dated Jan. 10, 2010 for Application No. 04 020 571.8; 5 pages.

Official Communication from the European Patent Office dated Dec. 21, 2009 for Application No. 04 011 558.6; 5 pages.

Official Communication from the European Patent Office dated Dec. 18, 2009 for Application No. 04 010 841.7-1231; 5 pages.

Decision from the Japan Patent Office dated Nov. 24, 2009 for Application No. 2004-254991; 7 pages.

Decision from the Japan Patent Office dated Jan. 12, 2010 for Application No. 2004-178924; 8 pages.

Non-Final Rejection from the Japan Patent Office dated Sep. 8, 2009 for Application No. 2004-178924; 12 pages.

First Office Action from the Taiwan Intellectual Property Office dated Feb. 9, 2010 for Application No. 93127468; 12 pages.

First Office Action from the Taiwan Intellectual Property Office dated May 6, 2010 for Application No. 93108084; 17 pages.

Non-Final Rejection from the Japan Patent Office dated Apr. 16, 2010 for Application No. 2005-183998; 18 pages.

Official Communication from the European Patent Office dated May 3, 2010 for Application No. 04 011 558.6; 10 pages.

* cited by examiner

METHOD OF MAKING A POWER INDUCTOR WITH REDUCED DC CURRENT SATURATION

CROSS-REFERENCE TO RELATED APPLICATIONS

This application is a Divisional of U.S. patent application Ser. No. 10/744,416 filed on Dec. 22, 2003, which is a Continuation-In-Part of U.S. patent application Ser. No. 10/621,128 filed on Jul. 16, 2003, which is incorporated herein by reference in its entirety.

FIELD OF THE INVENTION

The present invention relates to inductors, and more particularly to power inductors having magnetic core materials with reduced levels of saturation when operating with high DC currents and at high operating frequencies.

BACKGROUND OF THE INVENTION

Inductors are circuit elements that operate based on magnetic fields. The source of the magnetic field is charge that is in motion, or current. If current varies with time, the magnetic field that is induced also varies with time. A time-varying magnetic field induces a voltage in any conductor that is linked by the magnetic field. If the current is constant, the voltage across an ideal inductor is zero. Therefore, the inductor looks like a short circuit to a constant or DC current. In the inductor, the voltage is given by:

$$v = L\frac{di}{dt}.$$

Therefore, there cannot be an instantaneous change of current in the inductor.

Inductors can be used in a wide variety of circuits. Power inductors receive a relatively high DC current, for example up to about 100 Amps, and may operate at relatively high frequencies. For example and referring now to FIG. 1, a power inductor 20 may be used in a DC/DC converter 24, which typically employs inversion and/or rectification to transform DC at one voltage to DC at another voltage.

Referring now to FIG. 2, the power inductor 20 typically includes one or more turns of a conductor 30 that pass through a magnetic core material 34. For example, the magnetic core material 34 may have a square outer cross-section 36 and a square central cavity 38 that extends the length of the magnetic core material 34. The conductor 30 passes through the central cavity 38. The relatively high levels of DC current that flow through the conductor 30 tend to cause the magnetic core material 34 to saturate, which reduces the performance of the power inductor 20 and the device incorporating it.

SUMMARY OF THE INVENTION

A power inductor according to the present invention includes a first magnetic core having first and second ends. The first magnetic core includes a ferrite bead core material. An inner cavity in the first magnetic core extends from the first end to the second end. A slotted air gap in the first magnetic core extends from the first end to the second end. A second magnetic core is located at least one of in and adjacent to the slotted air gap.

In other features, the power inductor is implemented in a DC/DC converter. The slotted air gap is arranged in the first magnetic core in a direction that is parallel to a conductor passing therethrough. The second magnetic core has a permeability that is lower than the first magnetic core. The second magnetic core comprises a soft magnetic material. The soft magnetic material includes a powdered metal. Alternately, the second magnetic core includes a ferrite bead core material with distributed gaps.

In yet other features, a cross sectional shape of the first magnetic core is one of square, circular, rectangular, elliptical, and oval. The first magnetic core and the second magnetic core are self-locking in at least two orthogonal planes. Opposing walls of the first magnetic core that are adjacent to the slotted air gap are "V"-shaped.

In other features, the second magnetic core is "T"-shaped and extends along an inner wall of the first magnetic core. Alternately, the second magnetic core is "H"-shaped and extends partially along inner and outer walls of the first magnetic core.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
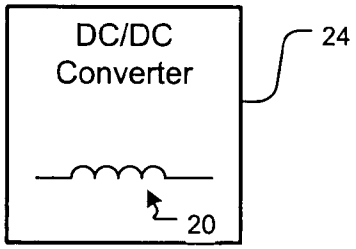
FIG. 1 Prior Art
FIG. 1 is a functional block diagram and electrical schematic of a power inductor implemented in an exemplary DC/DC converter according to the prior art.
Figure 3:
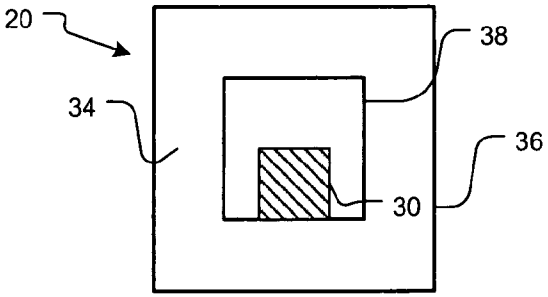
FIG. 3 Prior Art
FIG. 3 is a cross sectional view showing the power inductor of FIGS. 1 and 2 according to the prior art.
Figure 2:
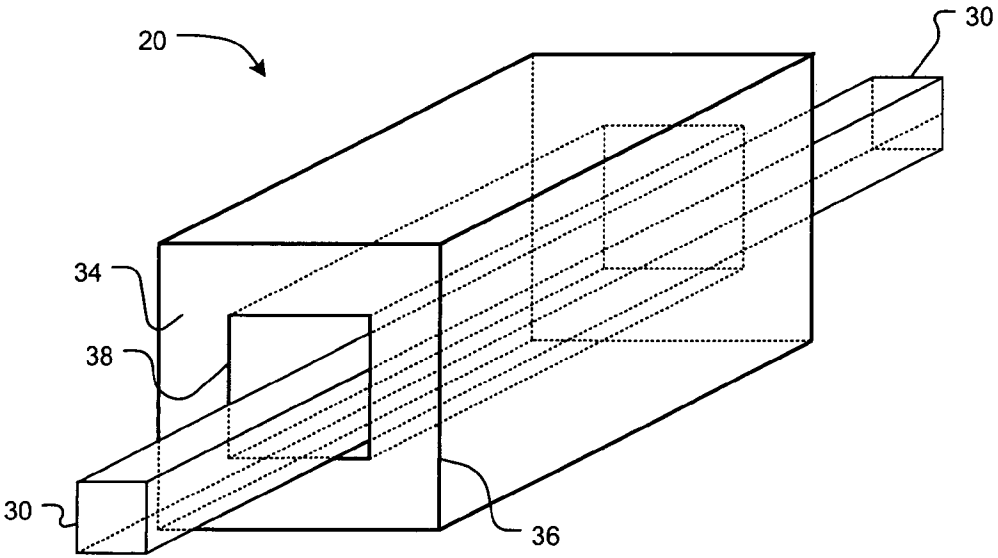
FIG. 2 Prior Art
FIG. 2 is a perspective view showing the power inductor of FIG. 1 according to the prior art.

The following description of the preferred embodiment(s) is merely exemplary in nature and is in no way intended to limit the invention, its application, or uses. For purposes of clarity, the same reference numbers will be used in the drawings to identify the same elements.

Figure 4:
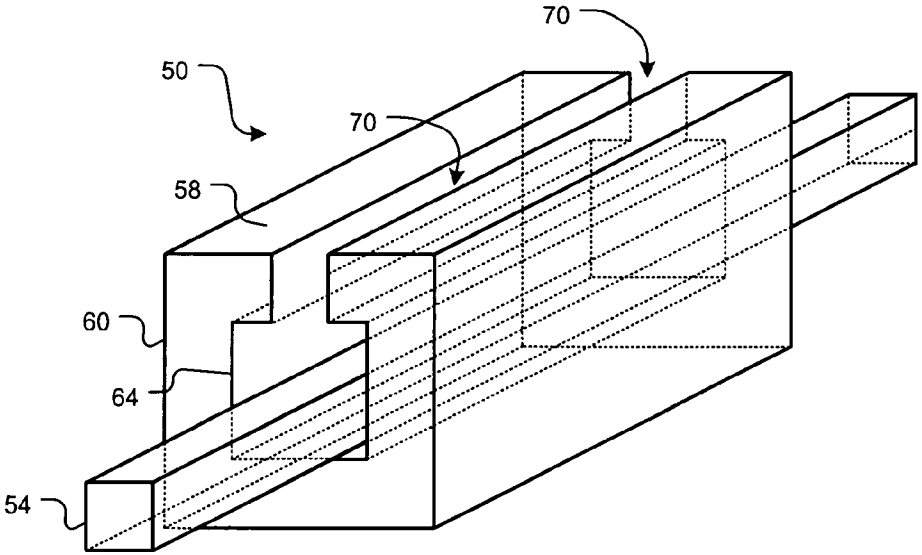
FIG. 4 is a perspective view showing a power inductor with a slotted air gap arranged in the magnetic core material according to the present invention.

Referring now to FIG. 4, a power inductor 50 includes a conductor 54 that passes through a magnetic core material 58. For example, the magnetic core material 58 may have a square outer cross-section 60 and a square central cavity 64 that extends the length of the magnetic core material. The conductor 54 may also have a square cross section. While the square outer cross section 60, the square central cavity 64, and the conductor 54 are shown, skilled artisans will appreciate that other shapes may be employed. The cross sections of the square outer cross section 60, the square central cavity 64, and the conductor 54 need not have the same shape. The conductor 54 passes through the central cavity 64 along one side of the cavity 64. The relatively high levels of DC current that flow through the conductor 30 tend to cause the magnetic core material 34 to saturate, which reduces performance of the power inductor and/or the device incorporating it.

According to the present invention, the magnetic core material 58 includes a slotted air gap 70 that runs lengthwise along the magnetic core material 58. The slotted air gap 70 runs in a direction that is parallel to the conductor 54. The slotted air gap 70 reduces the likelihood of saturation in the magnetic core material 58 for a given DC current level.

Figure 5:
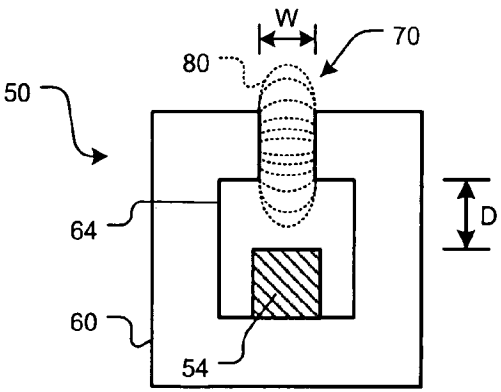
FIG. 5 is a cross sectional view of the power inductor of FIG. 4.

Referring now to FIG. 5, magnetic flux 80-1 and 80-2 (collectively referred to as flux 80) is created by the slotted air gap 70. Magnetic flux 80-2 projects towards the conductor 54 and induces eddy currents in the conductor 54. In a preferred embodiment, a sufficient distance "D" is defined between the conductor 54 and a bottom of the slotted air gap 70 such that the magnetic flux is substantially reduced. In one exemplary embodiment, the distance D is related to the current flowing through the conductor, a width "W" that is defined by the slotted air gap 70, and a desired maximum acceptable eddy current that can be induced in the conductor 54.

Figure 6B:
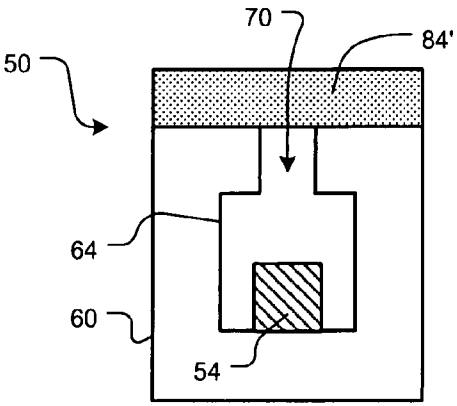
FIGS. 6A and 6B are cross sectional views showing alternate embodiments with an eddy current reducing material that is arranged adjacent to the slotted air gap.
Figure 6A:
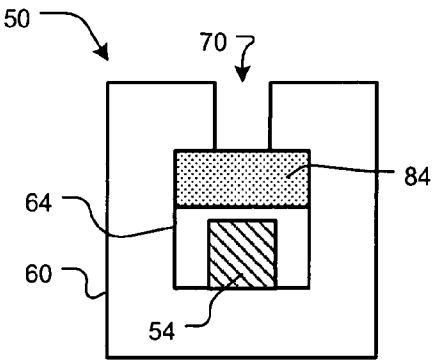

Referring now to FIGS. 6A and 6B, an eddy current reducing material 84 can be arranged adjacent to the slotted air gap 70. The eddy current reducing material has a lower magnetic permeability than the magnetic core material and a higher permeability than air. As a result, more magnetic flux flows through the material 84 than air. For example, the magnetic insulating material 84 can be a soft magnetic material, a powdered metal, or any other suitable material. In FIG. 6A, the eddy current reducing material 84 extends across a bottom opening of the slotted air gap 70.

In FIG. 6B, the eddy current reducing material 84' extends across an outer opening of the slotted air gap. Since the eddy current reducing material 84' has a lower magnetic permeability than the magnetic core material and a higher magnetic permeability than air, more flux flows through the eddy current reducing material than the air. Thus, less of the magnetic flux that is generated by the slotted air gap reaches the conductor.

Figure 7:
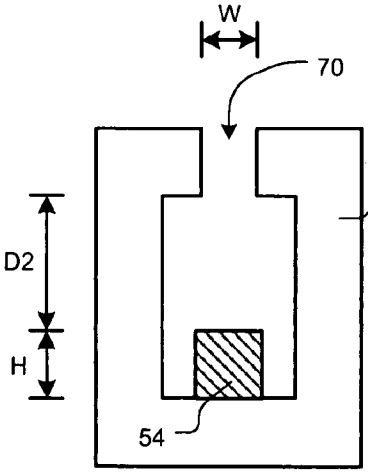
FIG. 7 is a cross sectional view showing an alternate embodiment with additional space between the slotted air gap and a top of the conductor.

For example, the eddy current reducing material 84 can have a relative permeability of 9 while air in the air gap has a relative permeability of 1. As a result, approximately 90% of the magnetic flux flows through the material 84 and approximately 10% of the magnetic flux flows through the air. As a result, the magnetic flux reaching the conductor is significantly reduced, which reduces induced eddy currents in the conductor. As can be appreciated, other materials having other permeability values can be used. Referring now to FIG. 7, a distance "D2" between a bottom the slotted air gap and a top of the conductor 54 can also be increased to reduce the magnitude of eddy currents that are induced in the conductor 54.

Figure 8:
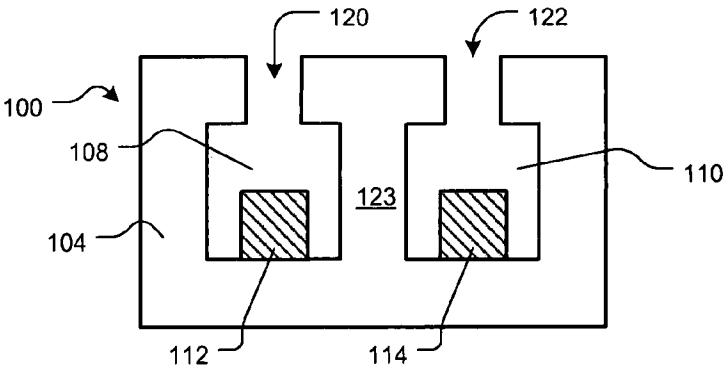
FIG. 8 is a cross sectional view of a magnetic core with multiple cavities each with a slotted air gap.

Referring now to FIG. 8, a power inductor 100 includes a magnetic core material 104 that defines first and second cavities 108 and 110. First and second conductors 112 and 114 are arranged in the first and second cavities 108 and 110, respectively. First and second slotted air gaps 120 and 122 are arranged in the magnetic core material 104 on a side that is across from the conductors 112 and 114, respectively. The first and second slotted air gaps 120 and 122 reduce saturation of the magnetic core material 104. In one embodiment, mutual coupling M is in the range of 0.5.

Figure 9A:
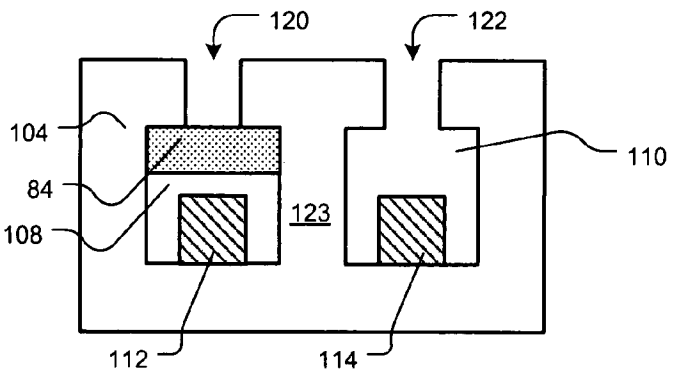
FIGS. 9A and 9B are cross sectional views of FIG. 8 with an eddy current reducing material arranged adjacent to one or both of the slotted air gaps.
Figure 9B:
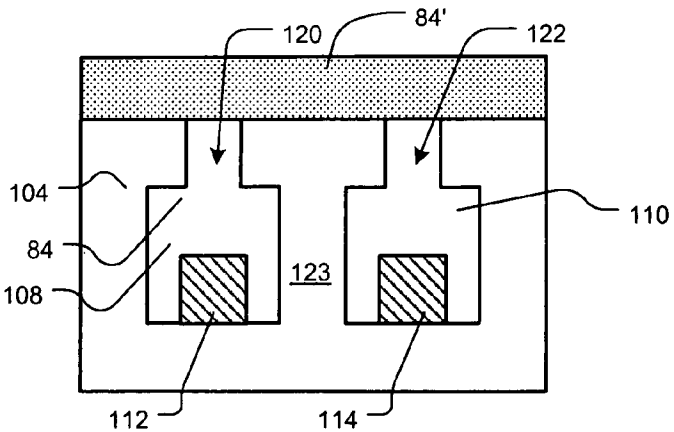

Referring now to FIGS. 9A and 9B, an eddy current reducing material is arranged adjacent to one or more of the slotted air gaps 120 and/or 122 to reduce magnetic flux caused by the slotted air gaps, which reduces induced eddy currents. In FIG. 9A, the eddy current reducing material 84 is located adjacent to a bottom opening of the slotted air gaps 120. In FIG. 9B, the eddy current reducing material is located adjacent to a top opening of both of the slotted air gaps 120 and 122. As can be appreciated, the eddy current reducing material can be located adjacent to one or both of the slotted air gaps. "T"-shaped central section 123 of the magnetic core material separates the first and second cavities 108 and 110.

Figure 10A:
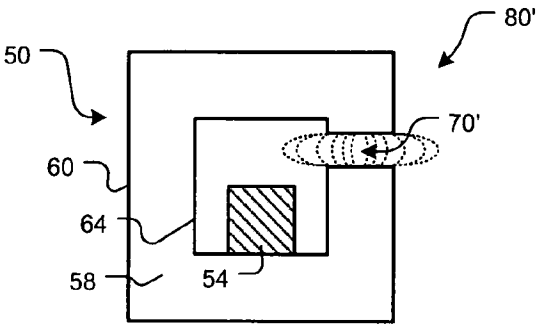
FIG. 10A is a cross sectional view showing an alternate side location for the slotted air gap.
Figure 10B:
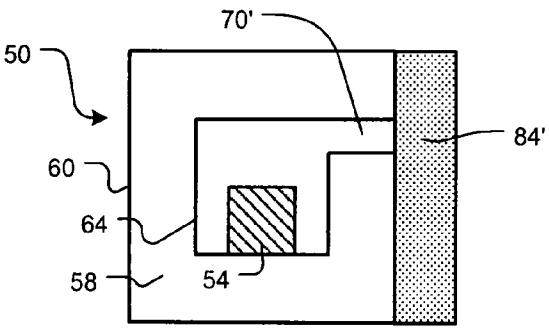
FIG. 10B is a cross sectional view showing an alternate side location for the slotted air gap.

The slotted air gap can be located in various other positions. For example and referring now to FIG. 10A, a slotted air gap 70' can be arranged on one of the sides of the magnetic core material 58. A bottom edge of the slotted air gap 70' is preferably but not necessarily arranged above a top surface of the conductor 54. As can be seen, the magnetic flux radiates inwardly. Since the slotted air gap 70' is arranged above the conductor 54, the magnetic flux has a reduced impact. As can be appreciated, the eddy current reducing material can arranged adjacent to the slotted air gap 70' to further reduce the magnetic flux as shown in FIGS. 6A and/or 6B. In FIG. 10B, the eddy current reducing material 84' is located adjacent to an outer opening of the slotted air gap 70'. The eddy current reducing material 84 can be located inside of the magnetic core material 58 as well.

Figure 11A:
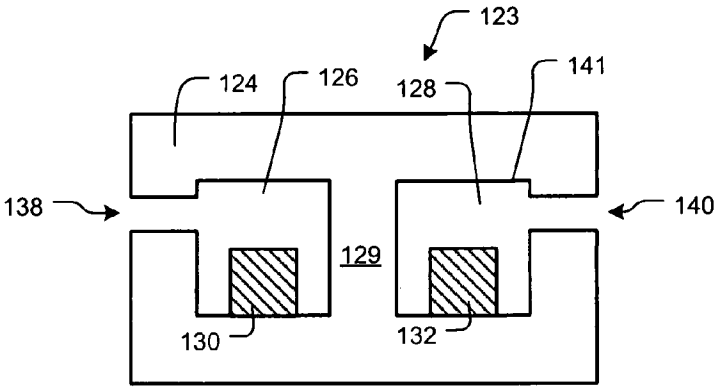
FIGS. 11A and 11B are cross sectional views of a magnetic core with multiple cavities each with a side slotted air gap.
Figure 11B:
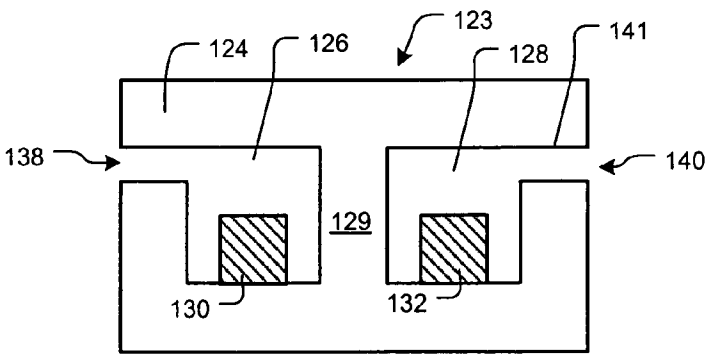

Referring now to FIGS. 11A and 11B, a power inductor 123 includes a magnetic core material 124 that defines first and second cavities 126 and 128, which are separated by a central portion 129. First and second conductors 130 and 132 are arranged in the first and second cavities 126 and 128, respectively, adjacent to one side. First and second slotted air gaps 138 and 140 are arranged in opposite sides of the magnetic core material adjacent to one side with the conductors 130 and 132. The slotted air gaps 138 and/or 140 can be aligned with an inner edge 141 of the magnetic core material 124 as shown in FIG. 11B or spaced from the inner edge 141 as shown in FIG. 11A. As can be appreciated, the eddy current reducing material can be used to further reduce the magnetic flux emanating from one or both of the slotted air gaps as shown in FIGS. 6A and/or 6B.

Figure 12:
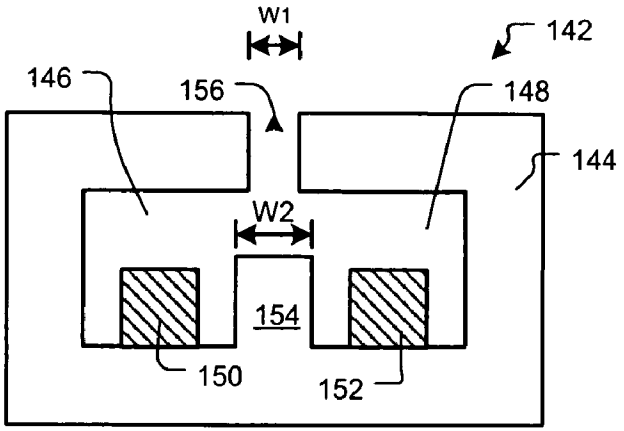
FIG. 12 is a cross sectional view of a magnetic core with multiple cavities and a central slotted air gap.
Figure 13:
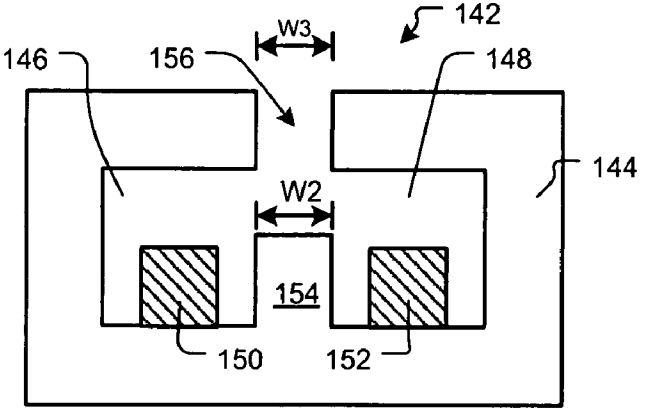
FIG. 13 is a cross sectional view of a magnetic core with multiple cavities and a wider central slotted air gap.
Figure 14:
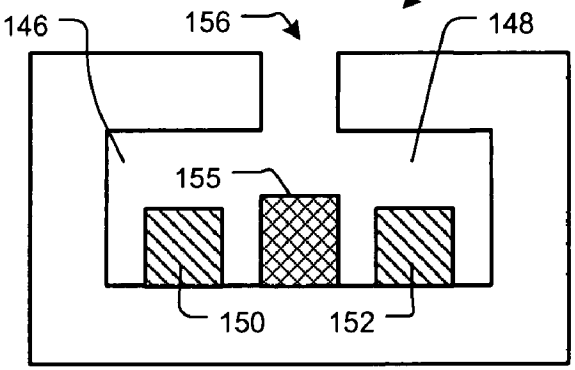
FIG. 14 is a cross sectional view of a magnetic core with multiple cavities, a central slotted air gap and a material having a lower permeability arranged between adjacent conductors.
Figure 15:
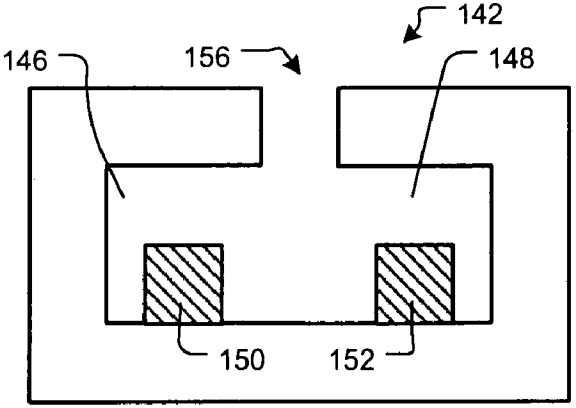
FIG. 15 is a cross sectional view of a magnetic core with multiple cavities and a central slotted air gap.

Referring now to FIGS. 12 and 13, a power inductor 142 includes a magnetic core material 144 that defines first and second connected cavities 146 and 148. First and second conductors 150 and 152 are arranged in the first and second cavities 146 and 148, respectively. A projection 154 of the magnetic core material 144 extends upwardly from a bottom side of the magnetic core material between the conductors 150 and 152. The projection 154 extends partially but not fully towards to a top side. In a preferred embodiment, the projection 154 has a projection length that is greater than a height of the conductors 150 and 154. As can be appreciated, the projection 154 can also be made of a material having a lower permeability than the magnetic core and a higher permeability than air as shown at 155 in FIG. 14. Alternately, both the projection and the magnetic core material can be removed as shown in FIG. 15. In this embodiment, the mutual coupling M is approximately equal to 1.

In FIG. 12, a slotted air gap 156 is arranged in the magnetic core material 144 in a location that is above the projection 154. The slotted air gap 156 has a width W1 that is less than a width W2 of the projection 154. In FIG. 13, a slotted air gap 156' is arranged in the magnetic core material in a location that is above the projection 154. The slotted air gap 156 has a width W3 that is greater than or equal to a width W2 of the projection 154. As can be appreciated, the eddy current reducing material can be used to further reduce the magnetic flux emanating from the slotted air gaps 156 and/or 156' as shown in FIGS. 6A and/or 6B. In some implementations of FIGS. 12-14, mutual coupling M is in the range of 1.

Figure 16:
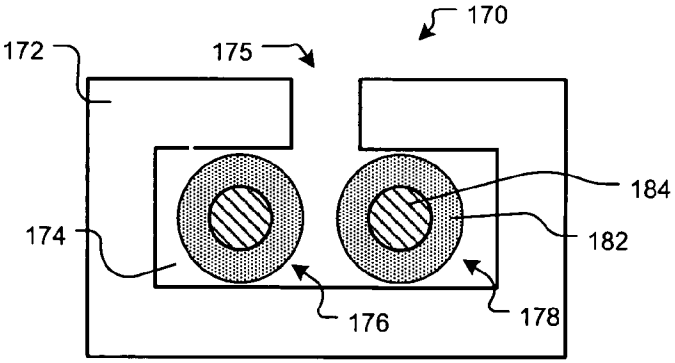
FIG. 16 is a cross sectional view of a magnetic core material with a slotted air gap and one or more insulated conductors.

Referring now to FIG. 16, a power inductor 170 is shown and includes a magnetic core material 172 that defines a cavity 174. A slotted air gap 175 is formed in one side of the magnetic core material 172. One or more insulated conductors 176 and 178 pass through the cavity 174. The insulated conductors 176 and 178 include an outer layer 182 surrounding an inner conductor 184. The outer layer 182 has a higher permeability than air and lower than the magnetic core material. The outer material 182 significantly reduces the magnetic flux caused by the slotted air gap and reduces eddy currents that would otherwise be induced in the conductors 184.

Figure 17:
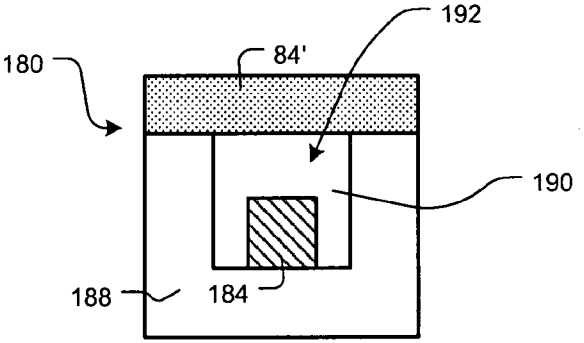
FIG. 17 is a cross sectional view of a "C"-shaped magnetic core material and an eddy current reducing material.
Figure 18:
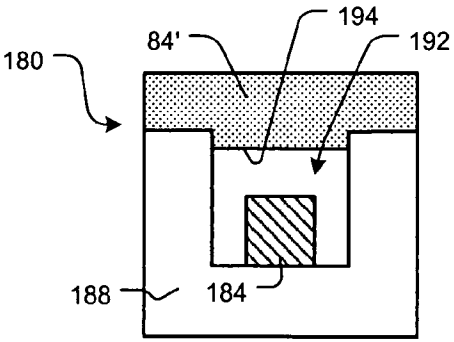
FIG. 18 is a cross sectional view of a "C"-shaped magnetic core material and an eddy current reducing material with a mating projection.

Referring now to FIG. 17, a power inductor 180 includes a conductor 184 and a "C"-shaped magnetic core material 188 that defines a cavity 190. A slotted air gap 192 is located on one side of the magnetic core material 188. The conductor 184 passes through the cavity 190. An eddy current reducing material 84' is located across the slotted air gap 192. In FIG. 18, the eddy current reducing material 84' includes a projection 194 that extends into the slotted air gap and that mates with the opening that is defined by the slotted air gap 192.

Figure 19:
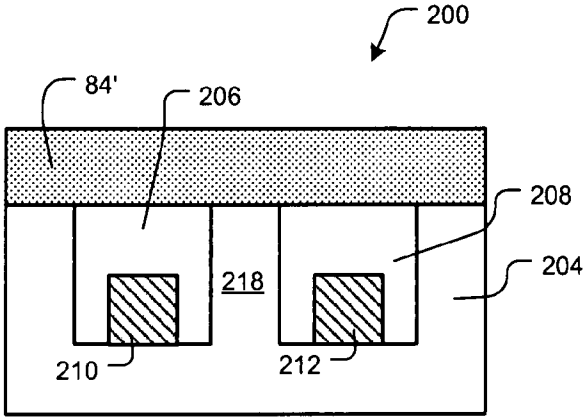
FIG. 19 is a cross sectional view of a "C"-shaped magnetic core material with multiple cavities and an eddy current reducing material.

Referring now to FIG. 19, the power inductor 200 a magnetic core material that defines first and second cavities 206 and 208. First and second conductors 210 and 212 pass through the first and second cavities 206 and 208, respectively. A center section 218 is located between the first and second cavities. As can be appreciated, the center section 218 may be made of the magnetic core material and/or an eddy current reducing material. Alternately, the conductors may include an outer layer.

The conductors may be made of copper, although gold, aluminum, and/or other suitable conducting materials having a low resistance may be used. The magnetic core material can be Ferrite although other magnetic core materials having a high magnetic permeability and a high electrical resistivity can be used. As used herein, Ferrite refers to any of several magnetic substances that include ferric oxide combined with the oxides of one or more metals such as manganese, nickel, and/or zinc. If Ferrite is employed, the slotted air gap can be cut with a diamond cutting blade or other suitable technique.

While some of the power inductors that are shown have one turn, skilled artisans will appreciate that additional turns may be employed. While some of the embodiments only show a magnetic core material with one or two cavities each with one or two conductors, additional conductors may be employed in each cavity and/or additional cavities and conductors may be employed without departing from the invention. While the shape of the cross section of the inductor has be shown as square, other suitable shapes, such as rectangular, circular, oval, elliptical and the like are also contemplated.

The power inductor in accordance with the present embodiments preferably has the capacity to handle up to 100 Amps (A) of DC current and has an inductance of 500 nH or less. For example, a typical inductance value of 50 nH is used. While the present invention has been illustrated in conjunction with DC/DC converters, skilled artisans will appreciate that the power inductor can be used in a wide variety of other applications.

Figure 20:
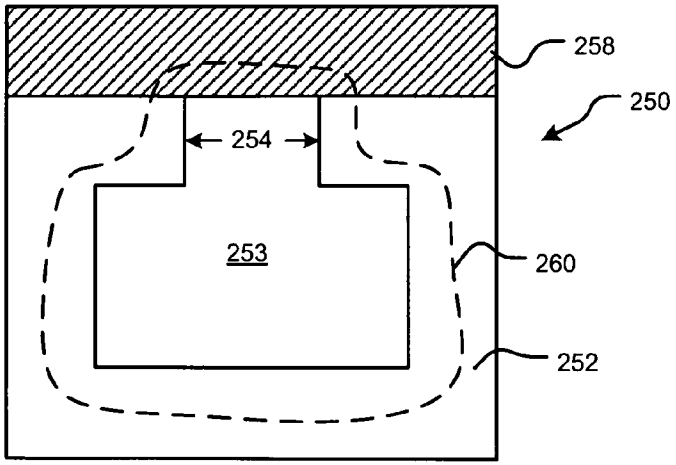
FIG. 20 is a cross sectional view of a "C"-shaped first magnetic core including a ferrite bead core material and a second magnetic core located adjacent to an air gap thereof.

Referring now to FIG. 20, a power inductor 250 includes a "C"-shaped first magnetic core 252 that defines a cavity 253. While a conductor is not shown in FIGS. 20-28, skilled artisans will appreciate that one or more conductors pass through the center of the first magnetic core as shown and described above. The first magnetic core 252 is preferably fabricated from ferrite bead core material and defines an air gap 254. A second magnetic core 258 is attached to at least one surface of the first magnetic core 252 adjacent to the air gap 254. In some implementations, the second magnetic core 258 has a permeability that is lower than the ferrite bead core material. Flux flows 260 through the first and second magnetic cores 252 and 258 as shown by dotted lines.

Figure 21:
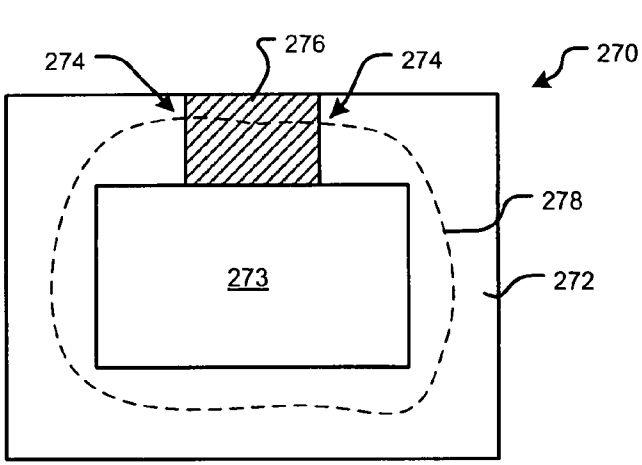
FIG. 21 is a cross sectional view of a "C"-shaped first magnetic core including a ferrite bead core material and a second magnetic core located in an air gap thereof.

Referring now to FIG. 21, a power inductor 270 includes a "C"-shaped first magnetic core 272 that is made of a ferrite bead core material. The first magnetic core 272 defines a cavity 273 and an air gap 274. A second magnetic core 276 is located in the air gap 274. In some implementations, the second magnetic core has a permeability that is lower than the ferrite bead core material. Flux 278 flows through the first and second magnetic cores 272 and 276, respectively, as shown by the dotted lines.

Figure 22:
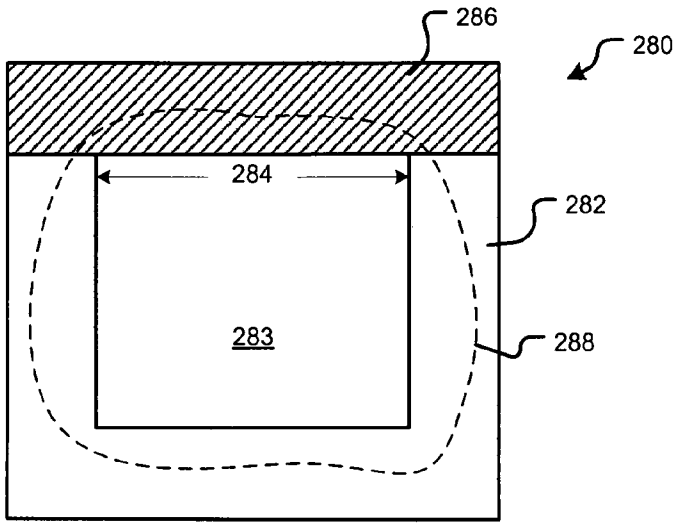
FIG. 22 is a cross sectional view of a "U"-shaped first magnetic core including a ferrite bead core material with a second magnetic core located adjacent to an air gap thereof.

Referring now to FIG. 22, a power inductor 280 includes a "U"-shaped first magnetic core 282 that is made of a ferrite bead core material. The first magnetic core 282 defines a cavity 283 and an air gap 284. A second magnetic core 286 is located in the air gap 284. Flux 288 flows through the first and second magnetic cores 282 and 286, respectively, as shown by the dotted lines. In some implementations, the second magnetic core 258 has a permeability that is lower than the ferrite bead core material.

Figure 23:
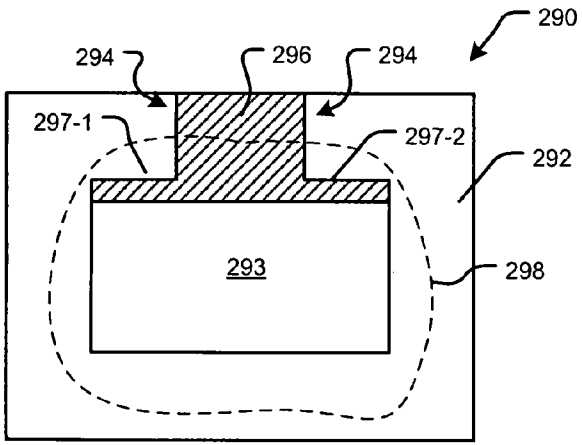
FIG. 23 illustrates a cross sectional view of a "C"-shaped first magnetic core including a ferrite bead core material and "T"-shaped second magnetic core, respectively.

Referring now to FIG. 23, a power inductor 290 includes a "C"-shaped first magnetic core 292 that is made of a ferrite bead core material. The first magnetic core 292 defines a cavity 293 and an air gap 294. A second magnetic core 296 is located in the air gap 294. In one implementation, the second magnetic core 296 extends into the air gap 294 and has a generally "T"-shaped cross section. The second magnetic core 296 extends along inner surfaces 297-1 and 297-2 of the first magnetic core 290 adjacent to the air gap 304. Flux 298 flows through the first and second magnetic cores 292 and 296, respectively, as shown by the dotted lines. In some implementations, the second magnetic core 258 has a permeability that is lower than the ferrite bead core material.

Figure 24:
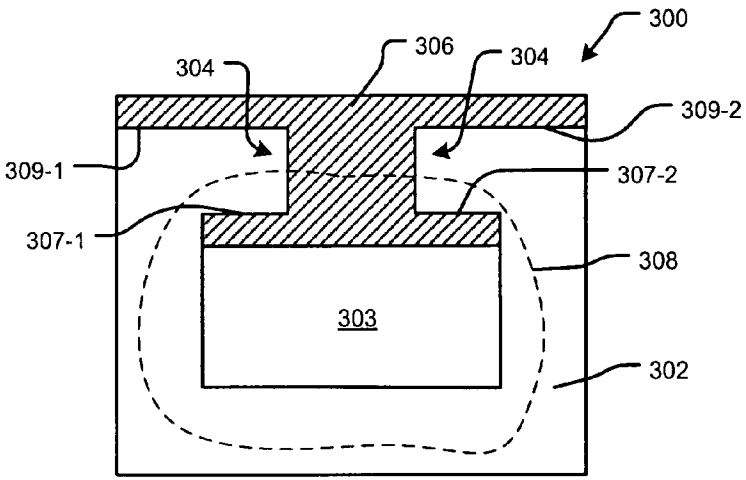
FIG. 24 illustrates a cross sectional view of a "C"-shaped first magnetic core including a ferrite bead core material and a self-locking "H"-shaped second magnetic core located in an air gap thereof.

Referring now to FIG. 24, a power inductor 300 includes a "C"-shaped first magnetic core 302 that is made of a ferrite bead core material. The first magnetic core 302 defines a cavity 303 and an air gap 304. A second magnetic core 306 is located in the air gap 304. The second magnetic core extends into the air gap 304 and outside of the air gap 304 and has a generally "H"-shaped cross section. The second magnetic core 306 extends along inner surfaces 307-1 and 307-2 and outer surfaces 309-1 and 309-2 of the first magnetic core 302 adjacent to the air gap 304. Flux 308 flows through the first and second magnetic cores 302 and 306, respectively, as shown by the dotted lines. In some implementations, the second magnetic core 258 has a permeability that is lower than the ferrite bead core material.

Figure 25:
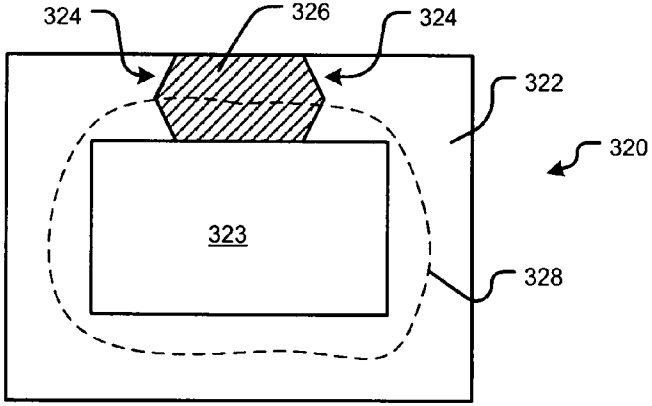
FIG. 25 is a cross sectional view of a "C"-shaped first magnetic core including a ferrite bead core material with a self-locking second magnetic core located in an air gap thereof.

Referring now to FIG. 25, a power inductor 320 includes a "C"-shaped first magnetic core 322 that is made of a ferrite bead core material. The first magnetic core 322 defines a cavity 323 and an air gap 324. A second magnetic core 326 is located in the air gap 324. Flux 328 flows through the first and second magnetic cores 322 and 326, respectively, as shown by the dotted lines. The first magnetic core 322 and the second magnetic core 326 are self-locking. In some implementations, the second magnetic core 258 has a permeability that is lower than the ferrite bead core material.

Figure 26:
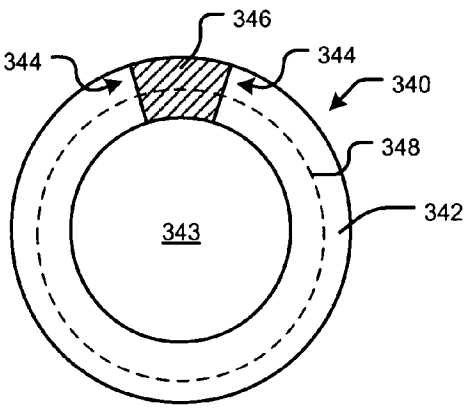
FIG. 26 illustrates an "O"-shaped first magnetic core including a ferrite bead core material with a second magnetic core located in an air gap thereof.

Referring now to FIG. 26, a power inductor 340 includes an "O"-shaped first magnetic core 342 that is made of a ferrite bead core material. The first magnetic core 342 defines a cavity 343 and an air gap 344. A second magnetic core 346 is located in the air gap 344. Flux 348 flows through the first and second magnetic cores 342 and 346, respectively, as shown by the dotted lines. In some implementations, the second magnetic core 258 has a permeability that is lower than the ferrite bead core material.

Figure 27:
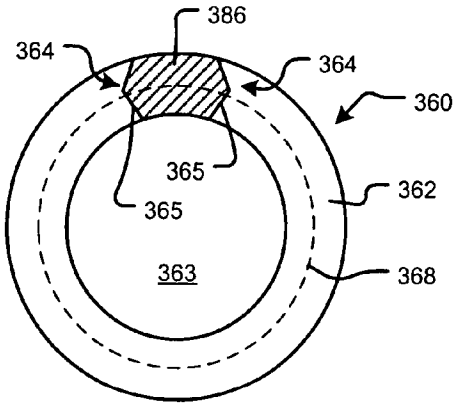

Referring now to FIG. 27, a power inductor 360 includes an "O"-shaped first magnetic core 362 that is made of a ferrite bead core material. The first magnetic core 362 defines a cavity 363 and an air gap 364. The air gap 364 is partially defined by opposed "V"-shaped walls 365. A second magnetic core 366 is located in the air gap 364. Flux 368 flows through the first and second magnetic cores 362 and 366, respectively, as shown by the dotted lines. The first magnetic core 362 and the second magnetic core 366 are self-locking. In other words, relative movement of the first and second magnetic cores is limited in at least two orthogonal planes. While "V"-shaped walls 365 are employed, skilled artisans will appreciate that other shapes that provide a self-locking feature may be employed. In some implementations, the second magnetic core 258 has a permeability that is lower than the ferrite bead core material.

Figure 28:
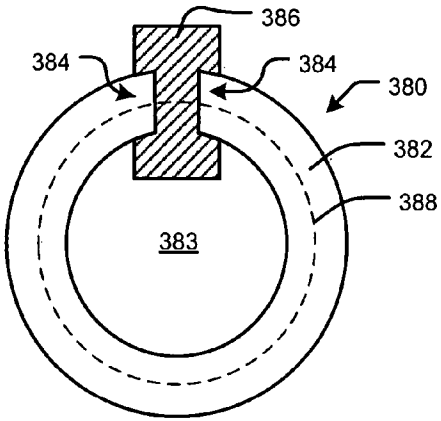
FIGS. 27 and 28 illustrate "O"-shaped first magnetic cores including ferrite bead core material with self-locking second magnetic cores located in air gaps thereof.

Referring now to FIG. 28, a power inductor 380 includes an "O"-shaped first magnetic core 382 that is made of a ferrite bead core material. The first magnetic core 382 defines a cavity 383 and an air gap 384. A second magnetic core 386 is located in the air gap 384 and is generally "H"-shaped. Flux 388 flows through the first and second magnetic cores 382 and 386, respectively, as shown by the dotted lines. The first magnetic core 382 and the second magnetic core 386 are self-locking. In other words, relative movement of the first and second magnetic cores is limited in at least two orthogonal planes. While the second magnetic core is "H"-shaped, skilled artisans will appreciate that other shapes that provide a self-locking feature may be employed. In some implementations, the second magnetic core 258 has a permeability that is lower than the ferrite bead core material.

In one implementation, the ferrite bead core material forming the first magnetic core is cut from a solid block of ferrite bead core material, for example using a diamond saw. Alternately, the ferrite bead core material is molded into a desired shape and then baked. The molded and baked material can then be cut if desired. Other combinations and/or ordering of molding, baking and/or cutting will be apparent to skilled artisans. The second magnetic core can be made using similar techniques.

One or both of the mating surfaces of the first magnetic core and/or the second magnetic core may be polished using conventional techniques prior to an attachment step. The first and second magnetic cores can be attached together using any suitable method. For example, an adhesive, adhesive tape, and/or any other bonding method can be used to attach the first magnetic core to the second core to form a composite structure. Skilled artisans will appreciate that other mechanical fastening methods may be used.

The second magnetic core is preferably made from a material having a lower permeability than the ferrite bead core material. In a preferred embodiment, the second magnetic core material forms less than 30% of the magnetic path. In a more preferred embodiment, the second magnetic core material forms less than 20% of the magnetic path. For example, the first magnetic core may have a permeability of approximately 2000 and the second magnetic core material may have a permeability of 20. The combined permeability of the magnetic path through the power inductor may be approximately 200 depending upon the respective lengths of magnetic paths through the first and second magnetic cores. In one implementation, the second magnetic core is formed using iron powder. While the iron powder has relatively high losses, the iron powder is capable of handling large magnetization currents.

Figure 29:
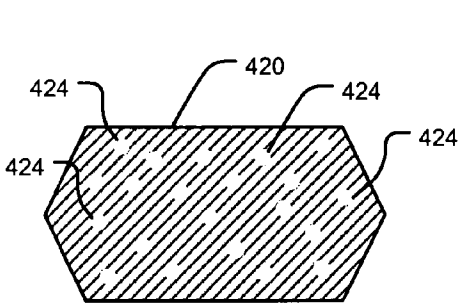
FIG. 29 illustrates a second magnetic core that includes ferrite bead core material having distributed gaps that reduce the permeability of the second magnetic core.

Referring now to FIG. 29, in other implementations, the second magnetic core is formed using ferrite bead core material 420 with distributed gaps 424. The gaps can be filled with air, and/or other gases, liquids or solids. In other words, gaps and/or bubbles that are distributed within the second magnetic core material lower the permeability of the second magnetic core material. The second magnetic core may be fabricated in a manner similar to the first magnetic core, as described above. As can be appreciated, the second magnetic core material may have other shapes. Skilled artisans will also appreciate that the first and second magnetic cores described in conjunction with FIGS. 20-30 may be used in the embodiments shown and described in conjunction with FIGS. 1-19.

Figure 30:
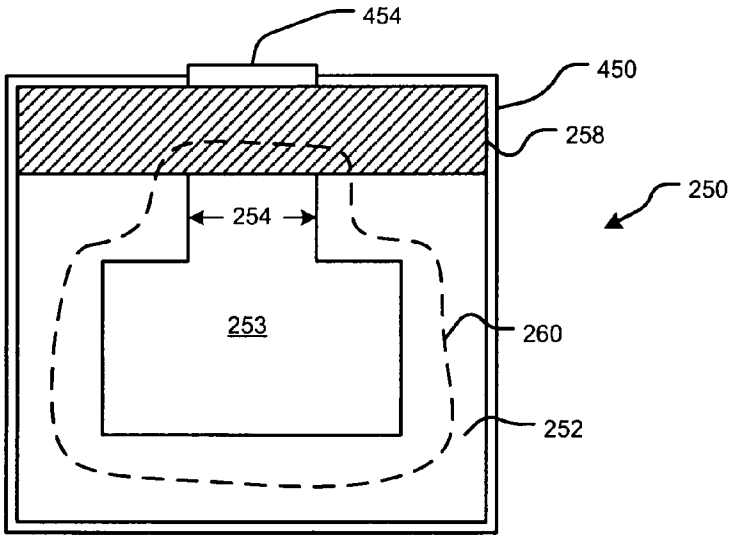
FIG. 30 illustrates first and second magnetic cores that are attached together using a strap.

Referring now to FIG. 30, a strap 450 is used to hold the first and second magnetic cores 252 and 258, respectively, together. Opposite ends of the strap may be attached together using a connector 454 or connected directly to each other. The strap 450 can be made of any suitable material such as metal or non-metallic materials.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, the specification and the following claims.

What is claimed is:

1. A method for making a power inductor comprising:

providing a first magnetic core comprising a ferrite bead core material;

cutting a first cavity and a first air gap in said first magnetic core;

attaching a second magnetic core to said first magnetic core at least one of in and adjacent to said air gap; and forming distributed gaps in said second magnetic core to lower a permeability of said second magnetic core.

2. The method of claim 1 wherein said second magnetic core includes ferrite bead core material and said distributed gaps comprise distributed air gaps.

3. A method for making a power inductor comprising:

providing a first magnetic core comprising a ferrite bead core material;

cutting a first cavity and a first air gap in said first magnetic core; and attaching a second magnetic core to said first magnetic core in said air gap, wherein said second magnetic core includes a second ferrite bead core material, and wherein said second magnetic core includes distributed gaps formed within said second ferrite bead core material to lower a permeability of said second magnetic core.

4. The method of claim 3 further comprising polishing at least one of said first and second magnetic cores prior to said attaching step.

5. The method of claim 3 wherein said attaching step includes bonding said first and second magnetic cores together.

6. The method of claim 3 wherein said providing step comprises molding and baking said first magnetic core.

7. The method of claim 3 wherein said providing step comprises cutting said first magnetic core from a block of said ferrite bead core material.

8. The method of claim 3 further comprising attaching said first and second magnetic cores together using at least one of adhesive and a strap.

* * * * *